United States Patent [19]

Shimomura et al.

[11] Patent Number: 4,667,632

[45] Date of Patent: May 26, 1987

[54] RPM CONTROL APPARATUS FOR INTERNAL COMBUSTION ENGINE

[75] Inventors: Setsuhiro Shimomura; Yukinobu Nishimura, both of Himeji, Japan

[73] Assignee: Mitsubishi Denki Kabushiki Kaisha, Tokyo, Japan

[21] Appl. No.: 846,142

[22] Filed: Mar. 31, 1986

[30] Foreign Application Priority Data

Apr. 2, 1985 [JP] Japan ..... 60-71520

[51] Int. Cl.[4] ..... F02D 41/16

[52] U.S. Cl. ..... 123/339; 123/340; 123/341; 123/352

[58] Field of Search ..... 123/339, 340, 341, 352, 123/585, 587

[56] References Cited

U.S. PATENT DOCUMENTS

| | | | |
|---|---|---|---|
| 4,305,360 | 12/1981 | Meyer et al. | 123/339 |
| 4,365,601 | 12/1982 | Yamazoe et al. | 123/339 |
| 4,401,073 | 8/1983 | Furuhashi | 123/339 |
| 4,563,989 | 1/1986 | Peter | 123/339 |

FOREIGN PATENT DOCUMENTS

| | | |
|---|---|---|
| 59-162340 | 9/1984 | Japan . |
| 1350052 | 4/1974 | United Kingdom . |
| 1429306 | 3/1976 | United Kingdom . |
| 2078400 | 1/1982 | United Kingdom . |
| 2128779 | 5/1984 | United Kingdom . |

*Primary Examiner*—Andrew M. Dolinar

*Attorney, Agent, or Firm*—Leydig, Voit & Mayer

[57] ABSTRACT

An RPM control apparatus for an internal combustion engine including a first limiter which suppresses an RPM feedback control signal indicating a target suction quantity or a target suction pipe pressure within a predetermined range that is set necessary and sufficient for covering a fluctuation range attributed to a no-load loss of the engine, and a second limiter which suppresses a suction feedback control signal on the basis of the output of the first limiter and an actual suction air quantity or suction pipe pressure within a predetermined range that is set necessary and sufficient for covering a fluctuation range attributed to the density of suction air, etc.

2 Claims, 2 Drawing Figures

RPM CONTROL APPARATUS FOR INTERNAL COMBUSTION ENGINE

BACKGROUND OF THE INVENTION

This invention relates to an apparatus for controlling the revolutions (hereinafter referred to as RPM) of an internal combustion engine which serves to feedback-control a no-load RPM of the internal combustion engine to a predetermined RPM.

Heretofore, such a no-load RPM of an internal combustion engine has been subjected to a constant-value control to a predetermined RPM. The purposes of this RPM control are to set the no-load RPM small so as to suppress the fuel economy in a no-load mode as far as possible, and to suppress the fluctuation of the RPM ascribable to disturbance, so that a rapid controllability of high precision is required.

Factors for the fluctuations of the RPM are broadly classified into a primary factor attributed to the fluctuation of a no-load loss of the engine itself and/or to the fluctuation of the thermal efficiency of the engine, and a secondary factor attributed to the fluctuation of an adjustment gain inherent in a suction adjustment means employed for adjusting the RPM fluctuation caused by the primary factor and/or to the fluctuation of the density of the atmospheric air forming an air suction source.

As disclosed in the Official Gazette of Japanese Patent Application Laid-Open No. 59-162340, accordingly, there has been proposed a method of controlling the RPM of the engine to a target value by generating a target suction quantity or suction pipe pressure in accordance with an adjustment signal based on the deviation between the target value and actual value of the RPM and of controlling the suction adjustment means in accordance with an adjustment signal based on the deviation between the generated target and an actual suction quantity or suction pipe pressure.

According to this method, the adjustment signal (RPM adjustment signal) based on the deviation between the target value and actual value of the RPM attends to the primary factor of the RPM fluctuation, while the adjustment signal (suction adjustment signal) based on the deviation between the target value and actual value of the suction quantity or the suction pipe pressure separately attends to the secondary factor. It is therefore clear that the RPM fluctuations can be adjusted with higher precision and at higher speed than in the case of a feedback control based on only the RPM.

The above construction, however, has a major disadvantage to be stated below: When a failure has taken place upon either the detection of the RPM or the detection of the suction quantity, the corresponding adjustment signal responds limitlessly to cause the engine to runaway or stop abnormally and to fall into an unfavorable situation.

SUMMARY OF THE INVENTION

This invention has been made in order to solve such a problem, and has for its object to provide an RPM control apparatus for an internal combustion engine by which any useless fluctuation of the RPM of the engine is prevented from arising even in a transient state, and by which even in case of a failure, the adjustment of the RPM is limited so that engine can be prevented from falling into the worst situation of runaway or stoppage.

The RPM control apparatus for an internal combustion engine according to this invention broadly comprises a first limiter which suppresses an RPM adjustment signal indicating a target suction quantity or target suction pipe pressure within a limit range that is set necessary and sufficient for covering a fluctuation range attributed to the primary factors of the RPM fluctuations of the engine, and a second limiter which suppresses a suction adjustment signal on the basis of the output of the first limiter and an actual suction quantity or suction pipe pressure within a limit range that is set necessary and sufficient for covering a fluctuation range attributed to the secondary factors of the RPM fluctuations.

In this invention, the RPM adjustment signal which fluctuates according to the fluctuations by the primary factors is suppressed by the first limiter within the limit range width which is necessary and sufficient for covering the fluctuation range attributed to the primary factors, while the suction adjustment signal which fluctuates according to the secondary fluctuating factors is suppressed by the second limiter within the limit range width which is necessary and sufficient for covering the fluctuation range attributed to the secondary factors.

BRIEF DESCRIPTION OF THE PREFERRED EMBODIMENT

Now, an embodiment of an RPM control apparatus for an internal combustion engine according to this invention will be described with reference to the accompanying drawings.

Figure 1:
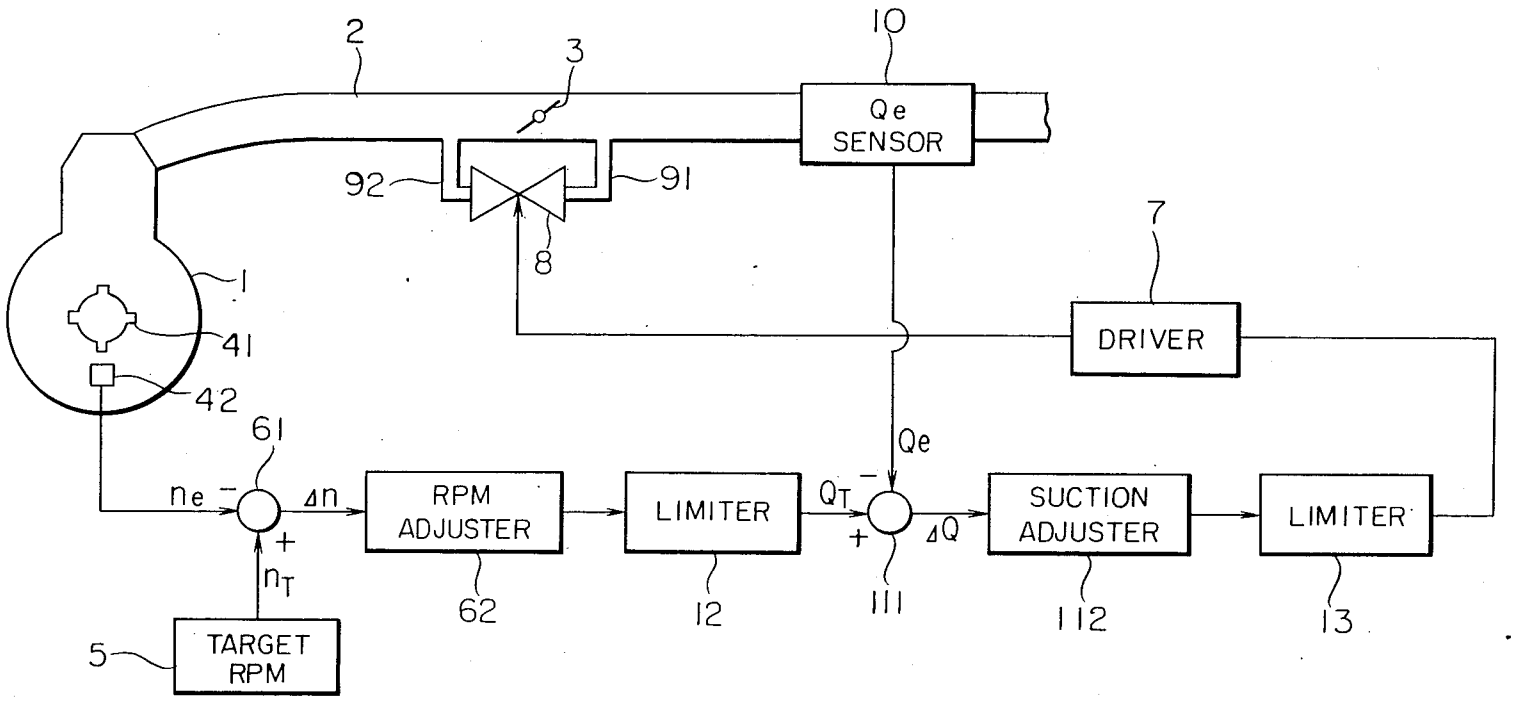
FIG. 1 shows a block diagram of one embodiment of an RPM control apparatus for an internal combustion engine according to this invention.

FIG. 1 is a block diagram showing the arrangement of the embodiment. In this figure, numeral 1 designates the internal combustion engine, to which a suction pipe 2 is connected.

A throttle valve 3 is disposed in a predetermined place of the suction pipe 2. The throttle valve 3 serves to control the RPM of the engine in correspondence with a load thereof. The suction pipe 2 is provided with bypass passages 91 and 92 at parts before and behind the throttle valve 3.

A suction control valve 8 is interposed between both the bypass passages 91 and 92. This suction control valve 8 is actuated by the output of a driver 7.

On the other hand, the internal combustion engine 1 is provided with a gear 41. The gear 41 interlocks with the rotation of the internal combustion engine 1. The rotation of the gear 41 is detected by an RPM (speed) sensor 42. The RPM sensor 42 detects the rotation of the gear 41, and delivers an engine RPM signal $n_e$ to an error amplifier 61.

The error amplifier 61 is also supplied with the output of a target RPM generator 5. It calculates the error $\Delta n$ between the output $n_e$ of the RPM sensor 42 and the output $n_T$ of the target RPM generator 5, and delivers the calculated error $\Delta n$ to an RPM adjuster 62.

The target RPM generator 5 generates target values of a no-load RPM in correspondence with the conditions of an engine temperature etc., while the RPM adjuster 62 receives the output of the error amplifier 61 and generates an RPM adjustment signal in the direction of eliminating the error $\Delta n$ owing to a proportional, integral or differential operation.

The output of the RPM adjuster 62 is sent to a limiter 12. This limiter 12 limits the output of the RPM adjuster 62 within a predetermined range.

The output of the limiter 12 assumes a target suction quantity $Q_T$ of the engine. This target suction quantity $Q_T$ is sent to an error amplifier 111. A suction quantity $Q_e$ from a suction quantity sensor 10 is also input to the error amplifier 111.

Thus, the error amplifier 111 calculates the error $\Delta Q$ between the target suction quantity $Q_T$ and the output of the suction quantity sensor 10, namely, the suction quantity $Q_e$, and delivers the calculated error $\Delta Q$ to a suction adjuster 112.

Upon receiving the error $\Delta Q$, the suction adjuster 112 generates a suction adjustment signal in the direction of eliminating the error $\Delta Q$ owing to a proportional, integral or differential operation, and delivers the signal to a limiter 13.

This limiter 13 limits the output of the suction adjuster 112 within a predetermined range. The output of the limiter 113 is sent to the driver 7. Upon receiving the output of the limiter 13, the driver 7 sends a drive signal to the suction control valve 8, which has its opening area controlled to increase or decrease by the drive signal.

A linear solenoid valve, a D.C. motor-controlled valve, or the like may be used as the suction control valve 8.

Next, the operation of the RPM control apparatus for an internal combustion engine according to this invention constructed as thus far described will be explained.

On the basis of the RPM error $\Delta n$, the RPM adjuster 62 is actuated to generate an output. Since this output is generated so as to decrease the error $\Delta n$, the RPM is settled or stabilized when the error $\Delta n$ is minimized.

Figure 2:
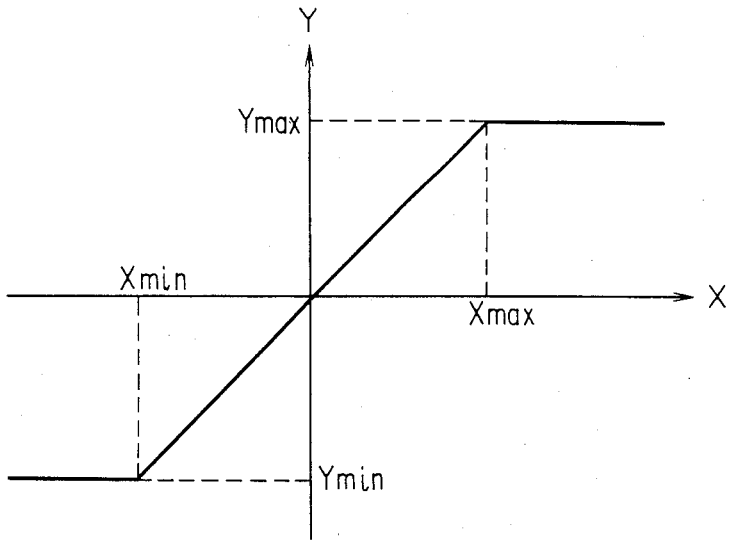
FIG. 2 is a diagram showing an example of the characteristic of a limiter in the embodiment of FIG. 1.

The output of the RPM adjuster 62 is applied to the limiter 12. As seen from a characteristic curve illustrated in FIG. 2, the limiter 12 generates an output Y proportional to an input X in the range of $X_{min} < X < X_{max}$, and it is intended to limit an excess output. The output of the limiter 12 forms the target value $Q_T$ of the engine suction quantity, and the error $\Delta Q$ thereof with respect to the output $Q_e$ of the suction quantity sensor 10 is calculated by the error amplifier 111.

The error $\Delta Q$ of the suction quantity actuates the suction adjuster 112 to generate an output. Since this output is generated so as to decrease the error $\Delta Q$, the suction quantity is settled when the error $\Delta Q$ is minimized. The output of the suction adjuster 112 is applied to the limiter 13. The characteristic curve of the limiter 13 is similar to that of the limiter 12. The output of the limiter 13 is converted into an electric signal by the driver 7.

The suction control valve 8 is actuated so as to have an opening area corresponding to the electric signal. This valve may comprise a solenoid valve whose posiiton changes in proportion to an input voltage, a D.C. motor-controlled valve whose position changes in proportion to a conduction rate, or the like. Air with flow rate corresponding to the opening area of the suction control valve 8 flows through the bypasses 91 and 92, so that the flow rate of air to be sucked in the internal combustion engine 1 is increased or decreased.

Thus, the RPM of the internal combustion engine 1 is settled to the target value. At this time, the suction quantity is also settled to the target value. The suction adjustment signal in this settled state adjusts the error $\Delta Q$ to the minimum.

That is, the suction adjustment signal adjusts errors inherent in various factors for adjusting the suction quantity, such as dispersion of a leakage air quantity of the throttle valve 3 at the no-load position thereof, characteristic fluctuations due to an initial characteristic error of the suction control valve 8 and temperatures etc., the supply voltage-dependency of the driver 7, and/or the dependency of gains on the density of the atmospheric air.

The limiter 13 has a proper limit value set in correspondence with a value into which these errors inherent in the above factors for adjusting the suction quantity are approximately cumulated. Accordingly, even when the suction adjustment signal is diverged in a case where the suction quantity $Q_e$ can not be fedback due to the malfunction of the suction quantity sensor 10, the adjustment operation is limited by the limiter 12, so that the divergence of the suction quantity is prevented. Therefore, the divergence (runaway or stop) of the engine RPM is prevented.

Next, the RPM adjustment signal adjusts the target suction quantity $Q_T$ so as to adjust the error $\Delta n$ to the minimum to bring the engine RPM $n_e$ into substantial agreement with the target RPM $n_T$. This is because the RPM adjustment signal adjusts the dispersion of the losses at various parts of the engine and the fluctuation of the thermal efficiency of the engine, and/or load fluctuations ascribable to various installations including lamps, motors etc. as observed in the case of an internal combustion engine for automobiles, etc.

The limiter 12 has a proper limit value set in correspondence with a value into which these errors attributed to the losses of the parts of the engine and the load fluctuations are approximately cumulated. Accordingly, even when the RPM adjustment signal is diverged in a case where the RPM can not be fedback due to the malfunction of the RPM sensor 42 or any other element, the adjustment operation is limited by the limiter 12, and the target value of the suction quantity does not diverge. Therefore, the divergence of the engine revolution number is prevented.

In the embodiment of FIG. 1 explained above, the adjustment signal is generated on the basis of only the difference between the target value and the actual value. However, it is also possible to generate the adjustment signal by combining a term proportional to the target value and a term based on the difference between the target value and the actual value.

For enhancing the effect of this invention, it is preferable that the adjustment speed of the suction adjuster 112 is higher than the adjustment speed of the revolution number adjuster 62. Therefore, the proportional, integral or differential adjustment gain of the suction adjuster 112 should preferably be set higher than that of the RPM adjuster 62.

Moreover, in order to achieve a similar effect, the limit value of the limiter 13 or 12 can be increased or decreased in the transient state of the adjusting operation.

Further, while the suction quantity sensor 10 is employed in the embodiment of FIG. 1, it is needless to say that a similar effect is achieved even when a suction pipe pressure sensor disposed downstream of the throttle valve 3 is used instead.

As described above, this invention consists in that the factors of RPM fluctuations are separated into one based on the loss of an engine and the other based on suction quantity adjustment means, and that limiters are disposed so as to limit the control ranges of an RPM adjuster and a suction adjuster in accordance with the respective factors in a necessary and sufficient manner. It is therefore possible to prevent the situation of the runaway or stop of the engine attributed to the fact that an adjusting operation is limitlessly performed in case of the failure or malfunction of any of various sensors etc.

What is claimed is:

1. An RPM control apparatus for an internal combustion engine for controlling RPM fluctuations of the engine comprising:

a target RPM generator for generating a target value of a no-load RPM on the basis of engine operating conditions;

a sensor for detecting at least one of a suction air quantity and a suction pipe pressure and generating signals representative thereof;

an RPM adjuster for generating an RPM adjustment signal for a target suction air quantity signal and a target suction pipe pressure signal for the engine on the basis of a relationship between the RPM of the engine and a target RPM represented by the target value;

a first limiter for limiting at least one of said target suction air quantity signal and said target suction pipe pressure signal within a predetermined range and for generating an output;

a suction adjuster for generating an adjustment signal output on the basis of a relationship between at least one of the suction air quantity signal and the suction pipe pressure signal and the output of said first limiter;

a second limiter for limiting the output of said suction adjuster within the predetermined range; and a suction control valve receiving the output of said second limiter for controlling RPM fluctuations.

2. An RPM control apparatus for an internal combustion engine as claimed in claim 1 wherein each said output of said first and second limiters is proportional to the RPM and suction adjustment signal and is between a maximum value and a minimum value forming said predetermined range.

* * * * *